US005509439A

United States Patent [19]

Tantardini

[11] Patent Number: 5,509,439

[45] Date of Patent: Apr. 23, 1996

[54] ELECTROMAGNETICALLY CONTROLLED OPERATING DEVICE IN PARTICULAR FOR VALVES AND ELECTROHYDRAULIC APPLICATIONS

[75] Inventor: Paolo Tantardini, Milan, Italy

[73] Assignee: Atos S.p.A., Sesto Calende, Italy

[21] Appl. No.: 272,305

[22] Filed: Jul. 8, 1994

Related U.S. Application Data

[63] Continuation of Ser. No. 998,685, Dec. 30, 1992, abandoned.

[30] Foreign Application Priority Data

May 28, 1992 [IT] Italy ..... MI91A1312

[51] Int. Cl.[6] ..... F15B 13/044

[52] U.S. Cl. ..... 137/269; 137/625.65; 251/129.08; 251/129.21

[58] Field of Search ..... 137/269, 495, 137/625.64, 625.65; 251/129.08, 129.21; 335/262; 418/31

[56] References Cited

U.S. PATENT DOCUMENTS

| | | | |
|---|---|---|---|
| 3,285,285 | 11/1966 | Bielefeld | 137/625.65 |
| 3,549,281 | 12/1970 | Schink et al. | 418/31 |
| 3,945,399 | 3/1976 | Tirelli | 137/529 |
| 4,046,165 | 9/1977 | Rose et al. | 137/624.27 |
| 4,513,780 | 4/1985 | Evans | 137/625.65 |
| 4,531,708 | 7/1985 | Livet | 251/129.21 X |
| 4,543,875 | 10/1985 | Imhof | 137/625.64 X |
| 4,655,249 | 4/1987 | Livet | 137/625.65 X |
| 4,699,571 | 10/1987 | Bartholomaus | 417/218 X |
| 4,917,150 | 4/1990 | Koch et al. | 137/625.65 |
| 4,979,542 | 12/1990 | Mesenich | 137/625.65 |
| 5,056,556 | 10/1991 | Nishimoto et al. | 251/129.15 X |

FOREIGN PATENT DOCUMENTS

| | | | |
|---|---|---|---|
| 61-236976 | 10/1986 | Japan | 251/129.15 |
| 61-290285 | 12/1986 | Japan | 251/129.15 |

*Primary Examiner*—Gerald A. Michalsky
*Attorney, Agent, or Firm*—Cushman Darby & Cushman

[57] ABSTRACT

The device comprises an electromagnet with a coil (2) and an armature (3) mobile by the action of the magnetic flux produced by the coil (2). The armature (3) is slidingly housed in a seat (6) in a guide body (4) and is preferably hollow, it being guided on a portion of a pin (11) which penetrates into the seat (6) and is fixed to the guide body (4). The pin (11) can comprise variously arranged channels (14–18) which can be connected together or closed by the armature (3) when in its various positions, to hence form various types of electrohydraulic valves. The compact structure and the minimum masses involved result in a high frequency response and small electrical operating power. The device can be incorporated into a module which also contains the electronic part for controlling the valve in accordance with a position transducer associated with a control element positioned within the module, the control element being operated to control for example power stages.

12 Claims, 6 Drawing Sheets

ELECTROMAGNETICALLY CONTROLLED OPERATING DEVICE IN PARTICULAR FOR VALVES AND ELECTROHYDRAULIC APPLICATIONS

This is a continuation of application Ser. No. 07/998,685, filed on Dec. 30, 1992, which was abandoned upon the filing hereof.

This invention relates to an electromagnetically controlled operating device, in particular to valves and electrohydraulic applications.

Operating devices of this type are known to comprise an electromagnet: consisting of a coil seated in a housing of magnetic material and generating a magnetic field for operating a moving armature. The armature is also made of a magnetic material, and directly or indirectly operates a control element, in particular an element for controlling the direction, pressure or throughput of a fluid, such as a valve slider, plug etc.

A device of this type applied to a valve is known for example from U.S. Pat. No. 3,945,399.

The various positions of the moving armature define the various hydraulic connections determined by the control element at the valve ports, and the relative direction, pressure or throughput control in accordance with known connection schemes.

These valves generally have a certain structural complexity and in particular are relatively lengthy, sometimes to an excessive extent for the elementary function which they perform.

In this respect, a typical valve of this type comprises, in sequence in the longitudinal direction, the moving armature, a relative fixed counter-armature, a pusher operated by the moving armature, a actual pusher-operated element for controlling the fluid direction, pressure or throughput, and normally also a terminal elastic return spring acting on the control element. If the control element is in the form of more than one valve plug of various shapes and/or structures, the structural complexity of the valve increases because of the presence of further mechanical elements and the need for seats and recesses to form the housings for the additional control and regulating elements.

In this, and many other cases, precision machining is required, to ensure correct positioning and alignment of the moving elements with low sliding friction.

It will be apparent that a large number of moving elements and the mass of each element generally limit the dynamic response of such operating devices, this being in total contrast to the control requirements of modern servo-systems, which require high dynamic response characterised by a frequency response of the order of 50–100 Hz.

The object of the present invention is to provide an electromagnetically controlled operating device, in particular for valves and electrohydraulic applications, which compared with known devices is of simple structure and compact configuration with flow moving parts, resulting in high electrical and mechanical efficiency and high response frequency.

This object is attained substantially by an electromagnetically controlled operating device, comprising a coil in a housing of magnetic material and a moving armature, also of magnetic material, able to assume at least two positions in accordance with the magnetic field produced by said coil in order to control the direction and/or pressure and/or throughput of a fluid or to operate a control element. The moving armature is slidingly housed in a seat in a fixed guide body of magnetic material, and characterised in that the moving armature is slidingly associated with a fixed guide, at least the fixed guide comprising at least one passage for controlling the direction and/or pressure and/or throughput of a fluid or for the movement of said control element. In a device configured in this manner, the armature slidable on or in the fixed guide can itself influence the fluid direction, pressure and/or throughput control element of a valve in combination with the guide, hence reducing the number of components and simplifying the structure and configuration of the valve. The moving armature can be substantially hollow and slidingly guided in its interior on a fixed pin forming the guide. The hollow moving armature can act directly on a control element movable on the pin and engaging the armature inside its cavity. The moving armature can advantageously be of minimum mass, allowing high frequency response for a small electromagnetic force and hence a requiring little electric power. The hollow armature guided on a small-diameter pin is less sensitive to impurities and hence has greater reliability over time. Since the armature is associated with the guide, simply replacing one and/or the other by an armature and/or a guide with a different configuration of internal passages enables various valve executions to be achieved, such as pressure regulating valves, maximum pressure valves, proportional valves, multi-way valves etc.

The low electrical power means that the electronic control system can be housed directly on the valve as there are no joule-effect heating problems. This means that modules can be formed incorporating the operating device and its electronic control part based on a position transducer associated with the control element or with an operating element itself associated with the element for controlling the fluid direction and/or pressure and/or throughput. High-precision mechanical machining and/or specific surface finishes are not required.

Further details and advantages will be more apparent from the description of some embodiments and applications of the invention given hereinafter by way of a non-limiting example with reference to the accompanying drawings, in which FIG. 1 is an axial section through a first embodiment of the device of the present invention as applied to a valve;

FIG. 1*a* shows the conventional symbol of the valve of FIG. 1;

FIG. 2 is a section through a second embodiment of the device of the present invention as applied to a valve;

FIG. 2*a* shows the conventional symbol of the valve of FIG. 2;

FIG. 3 is a section through a third embodiment of the present invention;

FIG. 3*a* shows the conventional symbol of the valve of FIG. 3;

Figure 5:
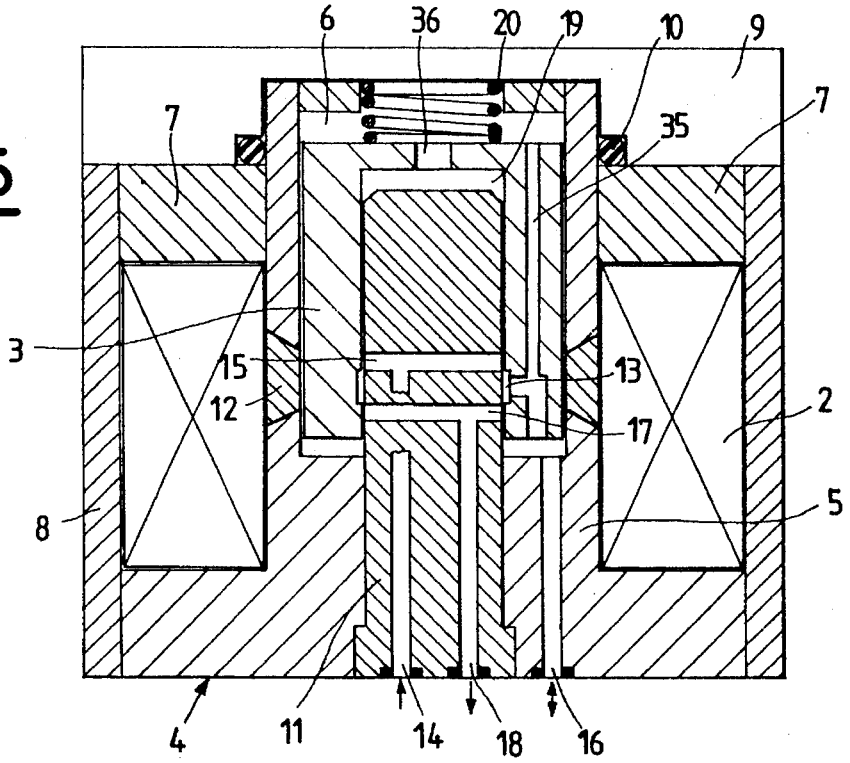
FIG. 5 is a section through a fifth embodiment of a device according to the present invention.
Figure 5A:
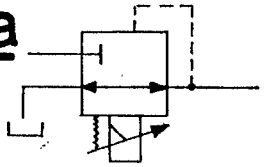
Figure 6:
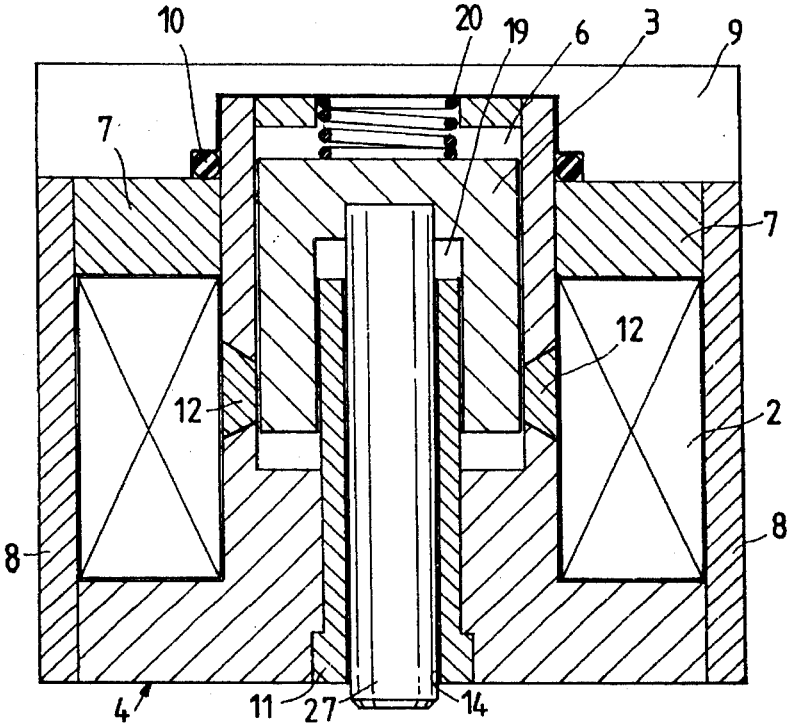
Figure 7:
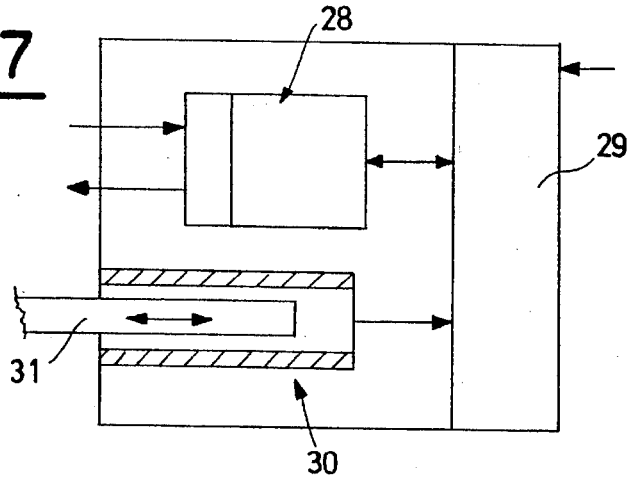
Figure 8:
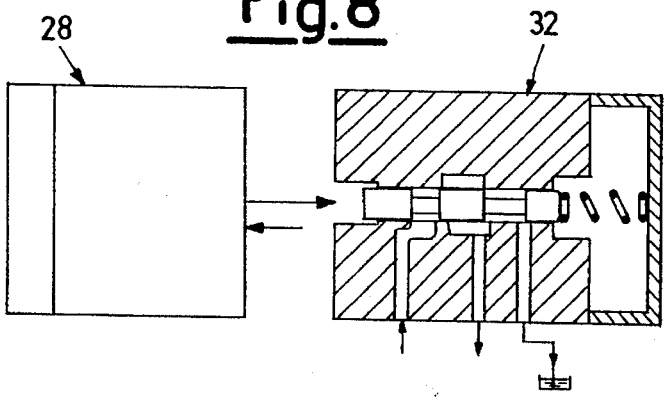
Figure 9:
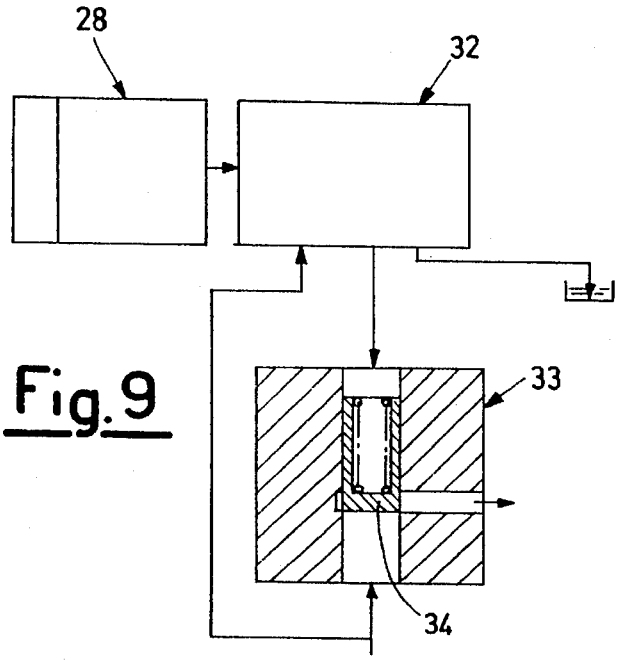
Figure 12:
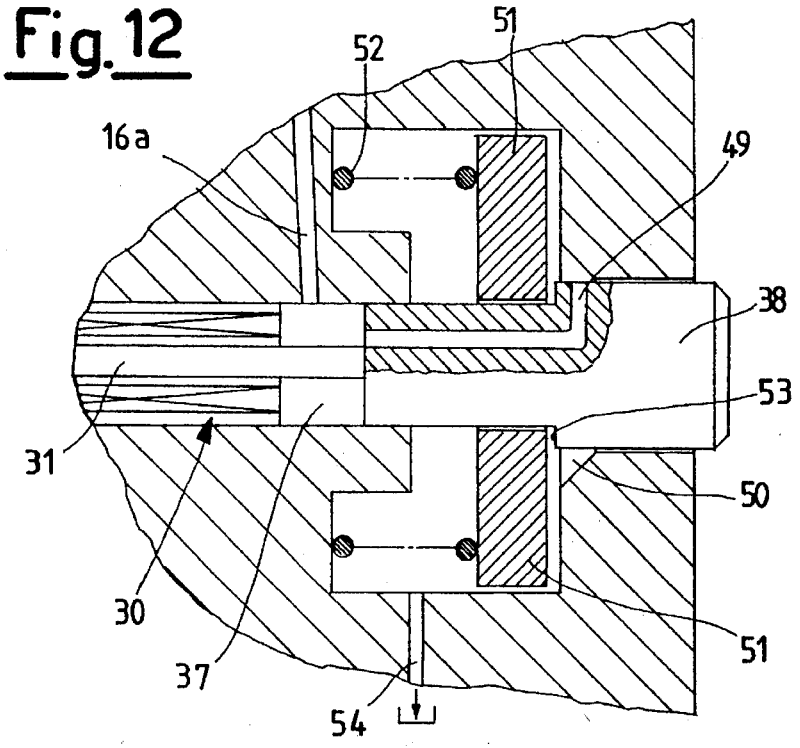
Figure 13:
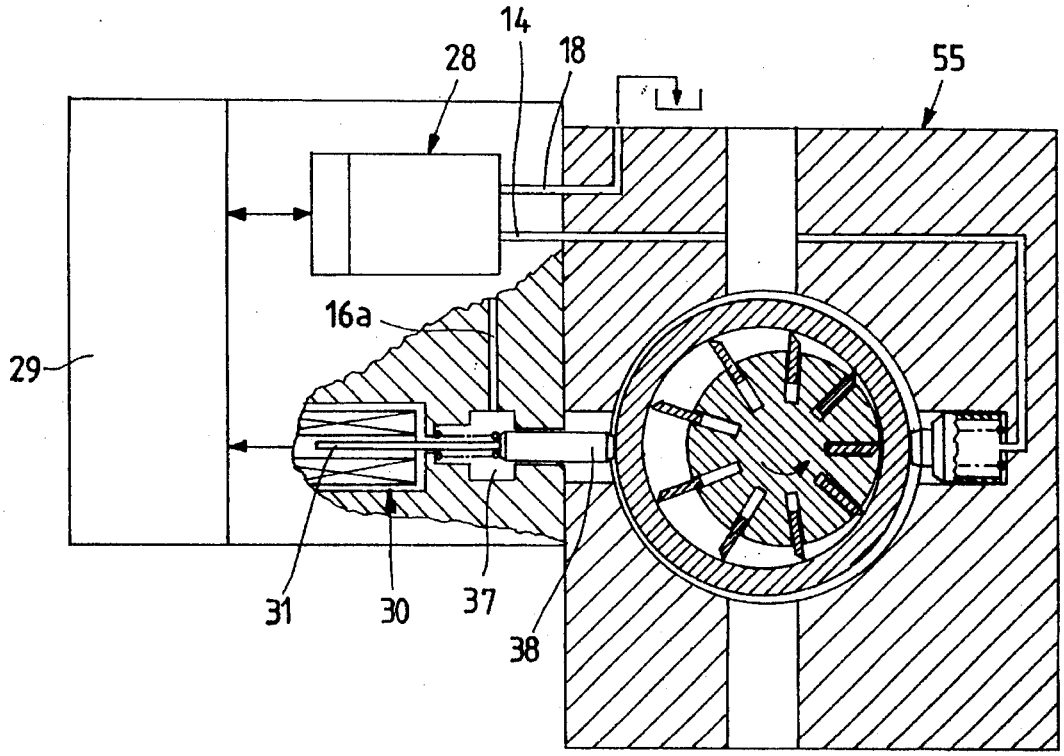
Figure 14:
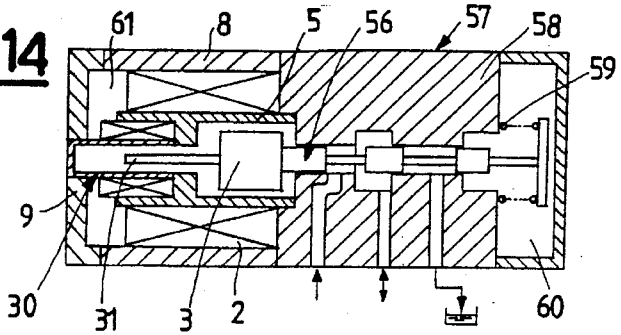
Figure 11A:
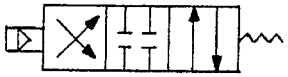
Figure 11:
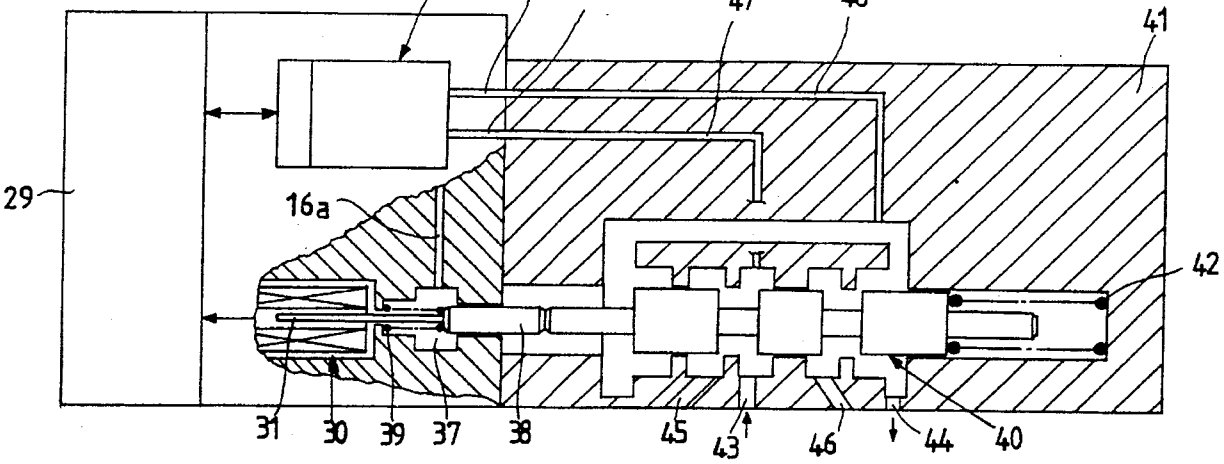
Figure 10:
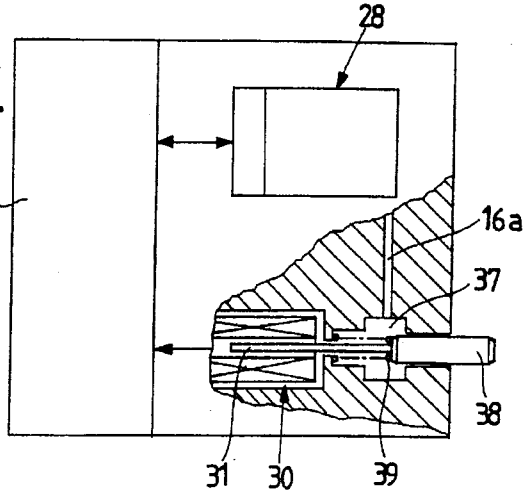

FIG. 5*a* shows the conventional symbol of the valve of FIG. 5;

FIG. 6 is a section through a further embodiment of a device according to the present invention;

FIGS. 7, 8 and 9 schematically illustrate some possible applications of the device according to the present invention;

FIG. 10 is a development of the valve module of FIG. 7;

FIG. 11 shows the application of the valve module of FIG. 10 to a directional control valve;

FIG. 11*a* shows the conventional symbol of the directional control valve of FIG. 10;

FIG. 12 shows a modification of the device of FIG. 10, which is particularly useful when applied to the valve module of FIG. 11;

FIG. 13 shows a further possible application of the valve module of FIG. 10;

FIG. 14 shows a further embodiment of a device according to the present invention.

With reference to the figures, an electromagnetically controlled operating device 1, intended particularly but not exclusively for valves and other electrohydraulic applications, comprises a coil 2 seated in a housing of magnetic material and an armature 3 of magnetic material mobile between at least two positions in accordance with the magnetic field produced by said coil 2. The coil 2 is connected by wires, not shown, to the electrical feed.

The housing consists of a guide body 4 of magnetic material externally housing the coil 2 and comprising a substantially cylindrical portion 5 inside which there is an axial seat 6 in which the moving armature 3 slides. One or more thrust bearings 7 of magnetic material surround the cylindrical portion 5 in proximity to its end, and a casing 8, also of magnetic material, laterally closes the magnetic circuit on the outside of the coil 2. A cover 9, which can define a stop for the moving armature 3 in its rest position, is fixed by means, not shown, to the housing for the coil 2 by way of hydraulic seal elements 10. The elements 4, 7 and 8 are held together by means, not shown.

The armature 3 is slidable with clearance within the seat 6, which has a length at least equal to the path of travel of the armature 3, which when under the action of the magnetic field produced by the coil 2 is attracted either towards the base of the seat 6 or towards the cover 9 against an opposing action as will be apparent hereinafter. The armature 3 is preferably of substantially hollow shape and is slidingly guided on or in a fixed guide, in particular a fixed pin 11, preferably of a non-magnetic material. As can be seen in the drawings, the armature 3 is substantially of an inverted cup shape, slidable internally on that portion of the pin 11 which penetrates into the seat 6. It can be seen in FIG. 1 that the cup-shape of armature 3 comprises an axially extending substantially cylindrical sleeve-like portion, which is closed off at its upper end. As can also be discerned from FIG. 1, the sleeve-like portion has a closed radially outer surface, which does not have any radially disposed openings therein. The pin 11 penetrates through the guide body 4 and is fixed to it. In a preferred embodiment it is forced into the body 4.

Inserts 12 of a non-magnetic material are advantageously positioned in the cylindrical portion 5 to deviate the magnetic flux so as to increase the flux which closes through the armature 3, and increasing the magnetic attraction action on the armature 3. As is apparent from the drawings, the device 1 is of simple structure and compact configuration, and in particular the moving armature 3 has minimum mass and offers small friction, resulting in high electrical and mechanical efficiency, with low consumption of electrical operating power.

In the embodiments shown in FIGS. 1, 2, 3 and 5, the operating device 1 is used in association with valves, in which case at least the guide or pin 11 comprises at least one passage for controlling the direction and/or pressure and/or throughput of a fluid in cooperation with the moving armature 3. The armature 3 advantageously comprises an annular recess 13 in the wall which slides on the pin 11, so as to open or close the fluid passage when the moving armature 3 is in its various positions, as described in greater detail hereinafter.

Figure 1:
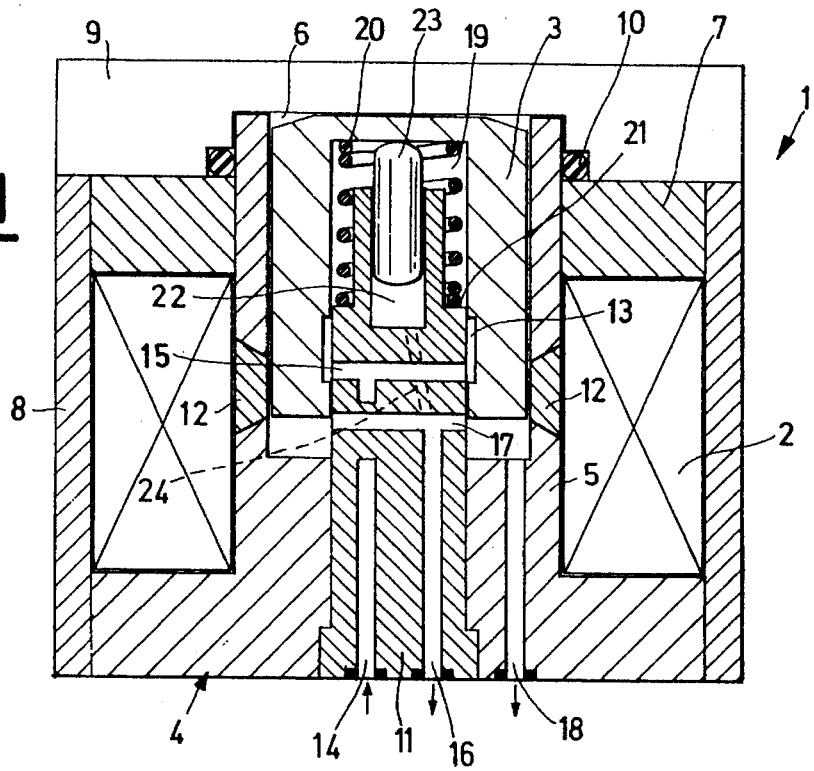

In the embodiment of FIG. 1 the pin 11 acts as a distributor and comprises a first longitudinal channel 14 which opens into a first transverse channel 15, and a second longitudinal channel 16 which opens into a second transverse channel 17. The channel 14 can be connected, for example, to a source of pressurized fluid and the channel 16 to a user. The guide body 4 comprises a channel 18 connecting the seat 6 to the outside, for example, to discharge. The size of the recess 13 in the axial direction is such as to be able to connect the two channels 15 and 17 together.

In the illustrated position, in which the moving armature 3 is in its rest position, the valve closes the feed and connects the user to discharge. On electrically powering the coil 2, the moving armature 3 moves until it abuts against the bottom of the seat 6, in which position the annular recess 13 connects the feed to the user, while the armature 3 closes the connection 18 to discharge. Advantageously the pin 11 defines with the interior of the cavity 19 in the armature 3 a chamber housing a spring 20 so as to oppose the movement of the armature 3 when under the action of the magnetic field generated by the coil 2, the spring 20 being interposed between a step 21 on the pin 11 and the base of the cavity 19 in the armature 3.

Figure 1A:
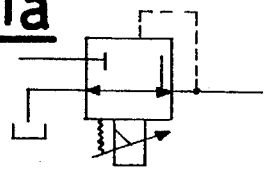

Again in the embodiment of FIG. 1, the pin 11 comprises an axial cavity 22 in its end portion which penetrates into the cavity 19 of the armature 3, the axial cavity 22 slidingly housing a piston 23 which at one end engages the armature 3 and at its other end forms with the base of the axial cavity 22 a chamber connected to the channel 17 via a channel 24. In this manner a pressure reducing valve is formed, in that the movement of the armature 3 is opposed not only by the spring 20 but also by the pressure acting on the piston 23 in accordance with the position of the armature 3, to throttle the fluid passage and establish an equilibrium condition which provides the user with a lower pressure than the feed pressure. FIG. 1*a* symbolically indicates the pressure reducing valve shown in FIG. 1.

Figure 2A:
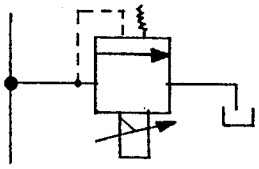
Figure 2:
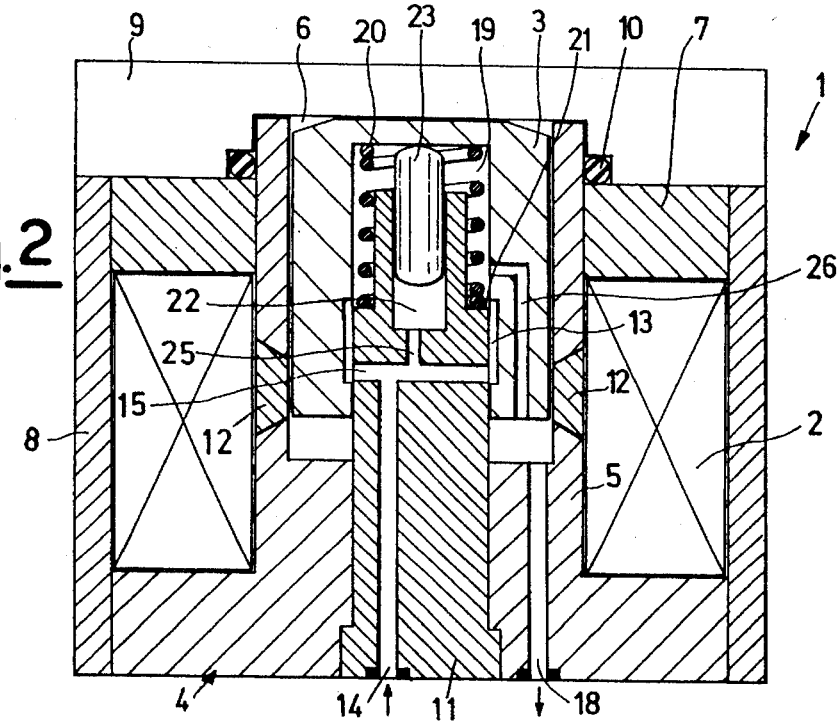

The embodiment of FIG. 2 differs from that of FIG. 1 only by a different arrangement of passages in the pin 11 and in the moving armature 3. The pin 11 comprises a single longitudinal channel 14, and a single transverse channel 15 connected to the channel 14 and to a channel 25 leading to the axial cavity 22 in the pin 11. The armature 3 again comprises the annular recess 13, plus a channel 26 connected at one end to the cavity 19 and at its other end to the seat 6 and consequently to the discharge channel 18. This embodiment represents a maximum pressure valve, with which the discharge port opens when a given pressure is exceeded. The scheme of FIG. 2*a* symbolizes this type of valve.

Figure 3:
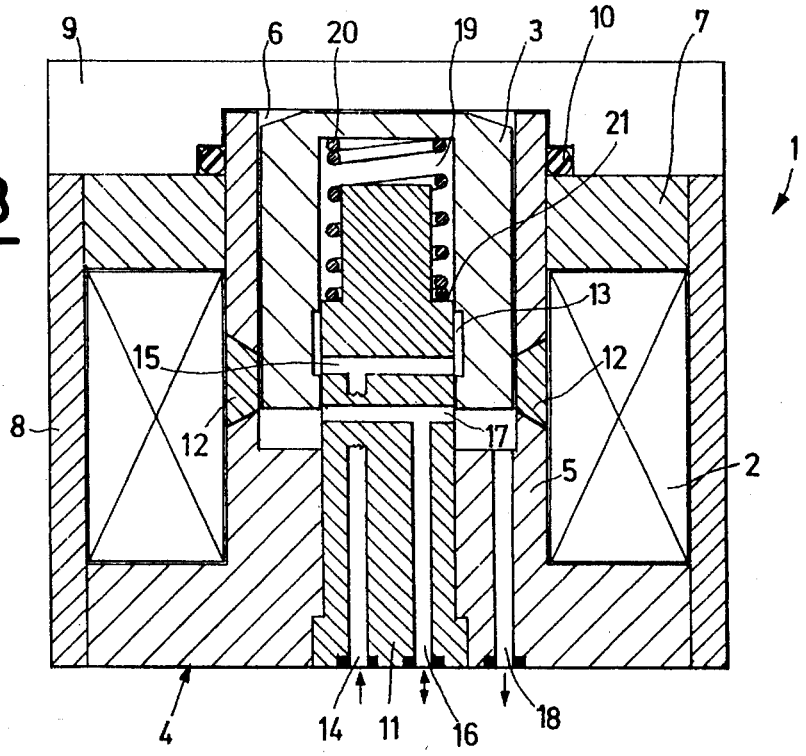
Figure 3A:
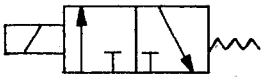

In the embodiment of FIG. 3 the pin 11 is without the axial cavity 22, the piston 23 and the channel 24. For the rest, the embodiment is identical to FIG. 1. The result is a three-way directional control valve, as the scheme of FIG. 3*a* shows. As will be apparent from the description, by maintaining the same basic structure and changing just a few elements, various types of directional, pressure or throughput control valves can be formed while maintaining the characteristics peculiar to the operating device of the invention.

Figure 4:
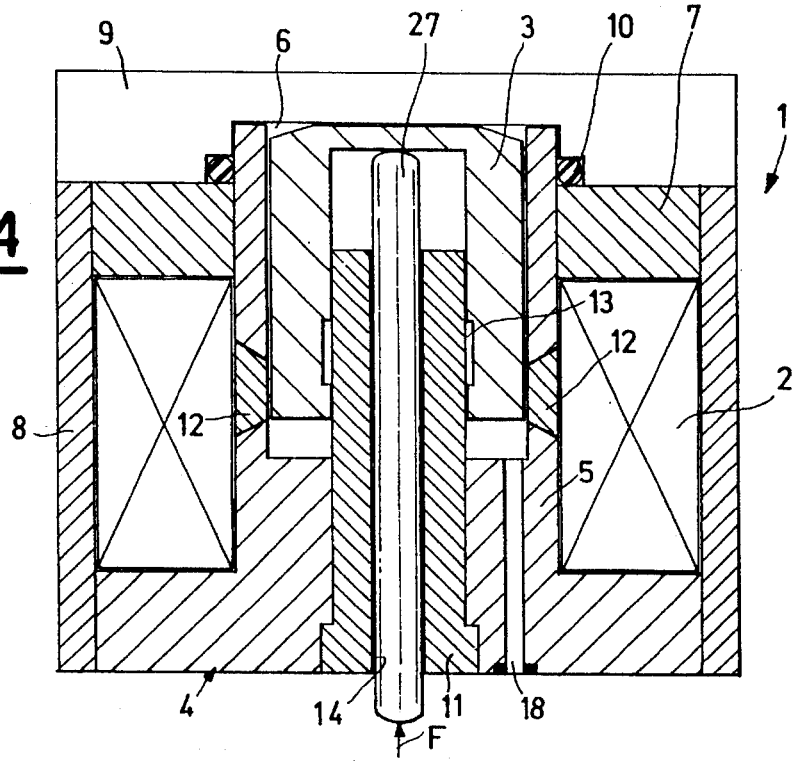
FIG. 4 is a section through a fourth embodiment of a device according to the present invention.

In the embodiment of FIG. 4 the pin 11 comprises a single axial passage 14, in which a rod-shaped control element 27 axially slides engaged at one end by the moving armature 3 and subjected at its other end to an opposing force indicated by the arrow F. In this manner an on-off or proportional operating device is formed, in which the moving armature 3 directly operates the control element 27.

In the embodiment of FIG. 5 the pin 11 comprises the channels 14–17 as in FIGS. 1 and 3, but is without the step 21. The guide body 4 penetrates partly into the cover 9 and the return spring 20 is external to the armature 3, being positioned between the cover 9 and the armature 3. The magnetic circuit is formed such as to attract the moving armature 3 towards the cover 9 when the coil 2 is energized, against the action of the spring 20. The moving armature comprises a through longitudinal channel 35 extending from one end of the armature 3 to the other and in continuous communication with the annular recess 13. That end of the armature 3 close to the cover 9 comprises a hole 36 which permanently connects the interior of the seat 6 to the cavity 19 in the hollow armature 3. The channels 16 and 18, connected to the user and to discharge respectively, are now inverted compared with those of the embodiments of FIGS. 1 and 3.

In this manner a pressure reducing valve is formed, as symbolized by the conventional scheme of FIG. 5*a*. This embodiment of the device according to the invention is particularly advantageous both from the constructional and operational viewpoint.

In the embodiment of FIG. 6 the moving armature 3 again acts against the opposing spring 20 positioned external to the armature 3, between this and the cover 9. The moving armature 3 rigidly carries the rod-like control element 27, which is slidingly guided within the fixed pin 11, the armature 3 being again guided on the pin 11. This embodiment does not require the opposing force indicated by the arrow F of FIG. 4. The control element 27 can be suitably connected to a slider or other movable element to which to transmit the movement produced by the armature 3 by the action of the magnetic field generated by the coil 2.

From the description it is apparent that a device according to the invention enables high frequency responses of the order of 100 Hz and more to be achieved with a small electromagnetic and spring force because of the minimum mass of the moving armature, which can be just a few grams in miniature executions.

The internal guiding of the armature 3 on the pin 11, which is of small diameter, and the clearance between the armature 3 and the cylindrical portion 15, result in low friction and lesser sensitivity to impurities present in the liquid.

The required electrical power is just a few watts, resulting in lower electricity consumption and lesser heating, making it possible to directly house the control electronics on the valve as shown for example in FIG. 7 in which the reference numeral 28 indicates the valve provided with the device of the invention, 29 the miniaturized control electronics for the valve, and 30 a position transducer with a movable member 31 to be connected to the actuator to be controlled, and of which the position signal is fed to the electronic part 29, which provides the power and demodulation for the transducer and acts as the interface with the central control system, all within an extremely small lightweight structure. In this manner modules can be built in the form of self-controlled electrohydraulic valves in which the operation is controlled by simple signal modulation.

A valve with the device of the invention can also be advantageously used as a pilot valve for valves or valve stages controlling considerable hydraulic powers, for example as shown in FIG. 8, in which a valve 28 provided with the device of the invention controls a stage 32 comprising a large-dimension slider or valve plug, which is positioned by the piloting pressure generated by the valve 28. A hydraulic gain of up to 1:100 can be achieved.

FIG. 9 shows an application similar to that of FIG. 8, but with a third stage 33 comprising a movable valve plug 34 controlled by the pressure of the fluid of the second stage 32. In this manner hydraulic gains of up to 1:1000 can be achieved and powers of up to more than 100 kW controlled.

FIG. 10 shows a valve module derived from the module of FIG. 7. The channel 16 of the valve 28 is connected to a working chamber 37 via a channel 16*a*, this channel and the chamber being provided within the module block comprising the valve 28. The pressurized fluid fed to the chamber 37 acts on a piston 38 to which the moving element 31 of the position transducer 30 is connected on the inside of the unit. The piston 38, slidable within the block and projecting from it, acts as a transmission or control member for the movement of a valve slider, pusher or transmission stem, as indicated for example in FIGS. 8, 9 and 11. A spring 39 defines the rest position of the piston 38 when not in operation.

The valve module of FIG. 10 can be applied for example as shown in FIG. 11. The piston 38 acts on the slider 40 of a known-art directional control valve 41 with two or more positions. The action of the piston 38 is opposed by a spring 42. The feed port of the distributor 41 is indicated by 43 and the discharge port by 44. The channels 45 and 46 are the flow outlets to the user. The conventional symbol for the directional control valve 41 is shown in FIG. 11*a*. The connections 47 and 48, formed within the body of the valve 41, lead to the channels 14 and 16 of the valve 28. FIG. 12 shows a modification of the control piston 38, of different operation. The piston 38 comprises an internal channel 49 extending from the internal base to the lateral surface, to open into a chamber 50 formed within the body of the valve assembly incorporating the valve 28. With the piston 38 there is associated a plunger 51, which is movable within the chamber 50 and is maintained by a spring 52 in an end-of-travel position in which it engages the piston 38 at a shoulder 53. A drain channel is indicated by 54.

This embodiment is particularly useful for application to a directional control valve such as that of FIG. 11. In this respect, with this latter if electrical power or pressure (or pilot flow) should accidentally fail, the slider 40 would be positioned in an end position of its travel by the action of the opposing spring 42, so making a hydraulic connection between directional control valve ports which could be dangerous or undesirable.

With the embodiment of FIG. 12, if electrical power or pressure fails the slider 40 is brought into a central position in which the feed and user ports are closed or are in a situation which does not create undesirable or dangerous connections.

In the absence of pilot pressure (situation also consequent on the lack of electrical power to the valve 28) the piston 38 is positioned by the plunger 51, via the spring 52, in an end position by which the slider 40 is moved to its central (safety) position.

When pilot pressure is present, this acts on the plunger 51 via the inner channel 49, to overcome the action of the spring 52 and hence maintain the plunger 51 in a position in which it no longer exerts any influence.

FIG. 13 shows a valve module incorporating the valve 28 as an operating unit acting via the piston 38 on a variable capacity pump 55 of known type, in order to control and vary the pump eccentricity.

FIG. 14 shows a further embodiment of a device according to the invention in which the armature 3 moves within the sleeve 5 surrounded by the coil 2, which is housed in the casing 8 closed by the cover 9. In this embodiment the armature 3 is connected to the slider 56 of a valve 57, the body 58 of which forms the fixed guide with which the armature 3 is slidingly associated via the slider 56. This body also comprises the passages for controlling the fluid direction.

The return spring 59 is external to the armature 3 and acts on the slider 56, it being positioned in a cavity 60 in the body 56. At the opposite end to the slider 56 the armature 3 rigidly carries moving element 31 of the linear position transducer 30, this being particularly useful for servo-controlling the operation. The electronic part of the valve can be advantageously positioned in the space 61 between the coil 2 and the cover 9. A particularly compact and functional embodiment is achieved.

Many other applicational variations and hydraulic arrangements are possible by suitably varying the channels in the guide for the moving armature 3 and/or in the armature itself.

I claim:

1. An electromagnetically controlled operating device for controlling the passage of a fluid therethrough comprising:

a housing made from a magnetic material, said housing having a first passage adapted to carry fluid therein, said first passage opening to one end of said operating device;

a coil disposed within said housing for generating a magnetic field;

a fixed guide disposed within said housing and having a second passage add a third passage extending therein for carrying fluid therethrough, said second passage and said third passage opening to said one end of said operating device adjacent to said first passage, said second passage having a longitudinal portion extending along a length of said fixed guide and a transverse portion extending transversely relative to the longitudinal portion, said third passage adapted to be connected to a discharge receptacle;

a cup-shaped armature made from a magnetic material and having a conduit therein, said armature being movable in response to application of said magnetic field along said fixed guide so that said conduit can be positioned to selectively obstruct and permit communication between said first passage in said housing and said second passage within said fixed guide so as to control the travel of said fluid between said first and second passages, said movable cup-shaped armature having a tubular portion with a substantially closed radially outer surface, an open end for receiving said fixed guide, and a radially inwardly extending portion extending radially inwardly from an end of said tubular portion opposite from said open end.

2. A device as claimed in claim 1, wherein said conduit in said armature comprises an annular recess in an inner cylindrical surface of said tubular portion and a longitudinally extending channel disposed within the tubular portion for communicating said first and second passages.

3. A device as claimed in claim 2, wherein said longitudinally extending channel of said conduit communicates at one end with a chamber above said cup-shaped armature, and at its other end with a chamber below said cup-shaped armature.

4. A device as claimed in claim 1, wherein said housing comprises a guide body defining a seat in which said armature is disposed, and wherein said first passage is disposed within said guide body and communicates said seat with an area external to the guide body.

5. A device as claimed in claim 1, wherein the housing comprises a substantially cylindrical portion internally defining a seat for said armature and externally defining at least a portion of a housing for said coil.

6. A device as claimed in claim 5, wherein said cylindrical portion comprises at least one insert made from a non-magnetic material for deviating the magnetic flux towards said movable armature.

7. A device as claimed in claim 1, wherein said housing comprises a guide body and said fixed guide is detachably connected to said guide body, said guide body being adapted to cooperate with other fixed guides of differing configurations.

8. A device as claimed in claim 1, wherein the armature is movable in response to said magnetic field against a return spring positioned externally of the armature.

9. A device as claimed in claim 8, wherein the housing comprises a guide body defining a seat in which said armature is disposed, and wherein said conduit in said armature comprises a longitudinal channel within said tubular portion for communicating an internal space within said armature with the armature seat.

10. A device as claimed in claim 8, wherein said spring is positioned between said armature and a cover of the housing.

11. An electromagnetically controlled operating device according to claim 1, wherein said first passage is adapted to be connected to a source of pressurized fluid and said second passage is adapted to be connected to a user.

12. An electromagnetically controlled operating device according to claim 1, wherein said housing comprises a guide body and a casing.

* * * * *